United States Patent [19]

Neville

[11] 4,303,111

[45] Dec. 1, 1981

[54] LOG FORMING MACHINE

[76] Inventor: Richard Neville, West Fork Rte., Darby, Mont. 59829

[21] Appl. No.: 90,564

[22] Filed: Nov. 2, 1979

[51] Int. Cl.[3] ..... B27C 5/08

[52] U.S. Cl. ..... 144/2 R; 144/134 R; 144/208 E

[58] Field of Search ..... 144/208 R, 208 E, 208 F, 144/311, 134 R, 323, 326 R, 2 R, 1 R

[56] References Cited

U.S. PATENT DOCUMENTS

| | | | |
|---|---|---|---|
| 2,646,092 | 7/1953 | Kolpe et al. | 144/208 E |
| 2,779,363 | 1/1957 | Laughton | 144/208 E |
| 2,799,304 | 7/1957 | Stewart | 144/208 E |
| 2,802,494 | 8/1957 | Nicholson | 144/208 E |
| 3,789,893 | 2/1974 | Carson et al. | 144/208 E |
| 3,913,644 | 10/1975 | Braun | 144/208 E |
| 3,951,187 | 4/1976 | Chisum | 144/1 R |
| 4,067,368 | 1/1978 | Beecroft | 144/134 R X |
| 4,122,877 | 10/1978 | Smith et al. | 144/208 E |

*Primary Examiner*—W. D. Bray
*Attorney, Agent, or Firm*—Wells, St. John & Roberts

[57] ABSTRACT

A device that forms smooth cylindrical surfaces along a log being moved longitudinally past a cutting station. The device includes a feed conveyor that moves successive logs longitudinally past a cutting station. A planetary cutting head drive is situated at the cutting station. The drive rotates a cutting head about a first planetary axis spaced from the log axis. It also revolves the cutting head about a stationary second axis that is coaxial with the log axis. A smooth cylindrical cut is thus made about the periphery of the log as it is moved longitudinally parallel to its axis.

11 Claims, 5 Drawing Figures

LOG FORMING MACHINE

BACKGROUND OF THE INVENTION

The present invention is related to log shaping machinery and more particularly to such machinery used to form substantially cylindrical logs as a construction material.

Natural wood logs are regaining popularity as a building material. Log homes have a special aesthetic appeal and can be energy efficient if properly constructed.

The insulative value of wood is not particularly high when values are measured through standard rectangular wooden boards. Logs, however, have a typical circular cross section that can lend a higher "R" value, depending upon the construction and type of wood. Conventional "R" values can vary not only with the thickness of wood, but also with its cross-sectional curvature. Annular rings and the cellular content of the wood add insulative qualities to the overall wood thickness. Escaping heat is trapped at successive circular barriers formed by the annular rings and within the tiny open cellular structure of the wood grain. The circular cross-sectional configuration of the logs forming a structure wall is therefore a very desirable feature.

One prevalent problem with log construction has been the requirement of properly fitting logs together to obtain continuous, closed joints along their full length. Logs have a natural taper from one end to the other. Log taper can partially be corrected in construction by reversing lengths (end-for-end) of successive logs as the wall is being constructed. This technique, however, only solves the problem where tapers are nearly identical. Ideally, logs should be perfectly round, both for proper insulation value and for highest structural stability.

It therefore becomes desirable to obtain a machine that will automatically form logs accurately with surfaces that are substantially cylindrical and centered about their longitudinal axes. The individual logs should be of uniform diameter to facilitate uniform construction of structural walls and to provide uniform insulative capacity.

DETAILED DESCRIPTION OF A PREFERRED EMBODIMENT

Figure 5:
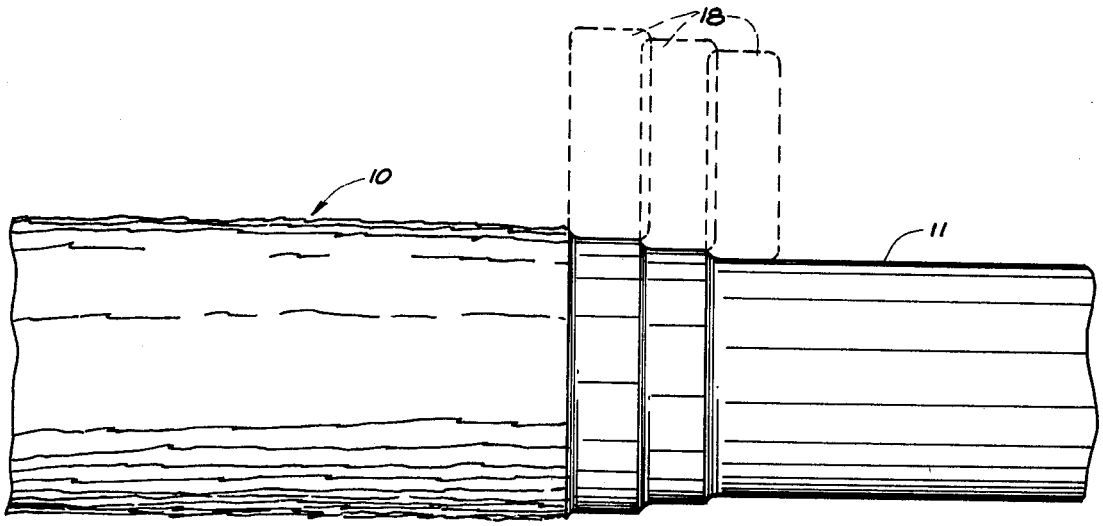
FIG. 5 is a pictorial view of a partially formed log with successive cutting heads shown by dotted lines.

The device of the present invention is provided to operate on logs such as that shown at 10 in FIG. 5. The device functions to form cylindrical finished surfaces 11 along the length of the logs, the surfaces being centered about the longitudinal axis of the log.

The cylindrical surfaces 11 are cut into the log as it is moved by a conveyor mechanism 16 (FIG. 1) longitudinally past a cutting station framework 17. Cutting heads 18 (FIGS. 2-5) at the cutting station framework rotate about planetary first axes, which in turn revolve about a stationary second axis coaxial with the log axis. Knives 53 about the periphery of the rotating cutting heads 18 trim the surfaces of the logs to the desired cylindrical shape.

Figure 1:
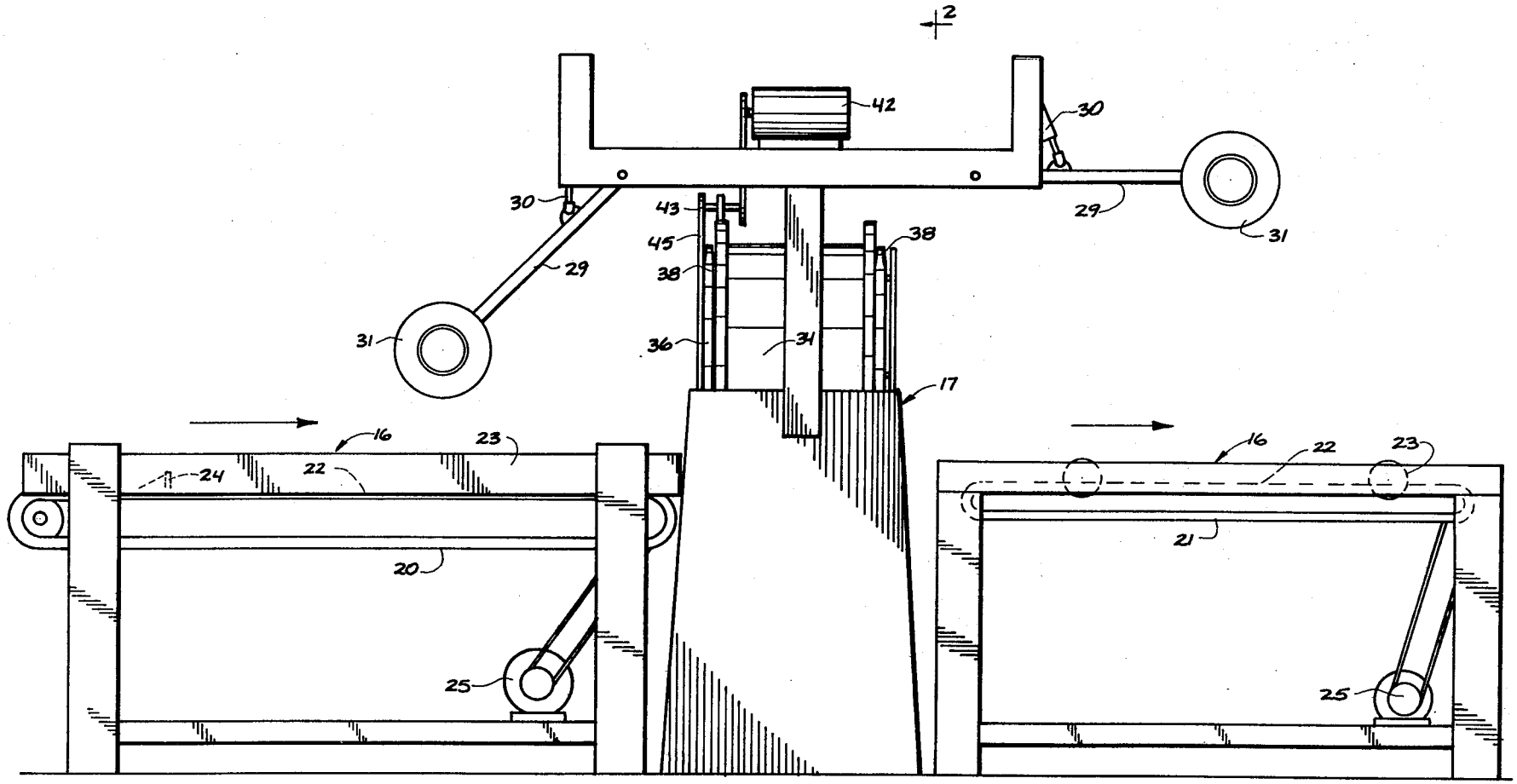
FIG. 1 is a side elevational view of the present device.
Figure 2:
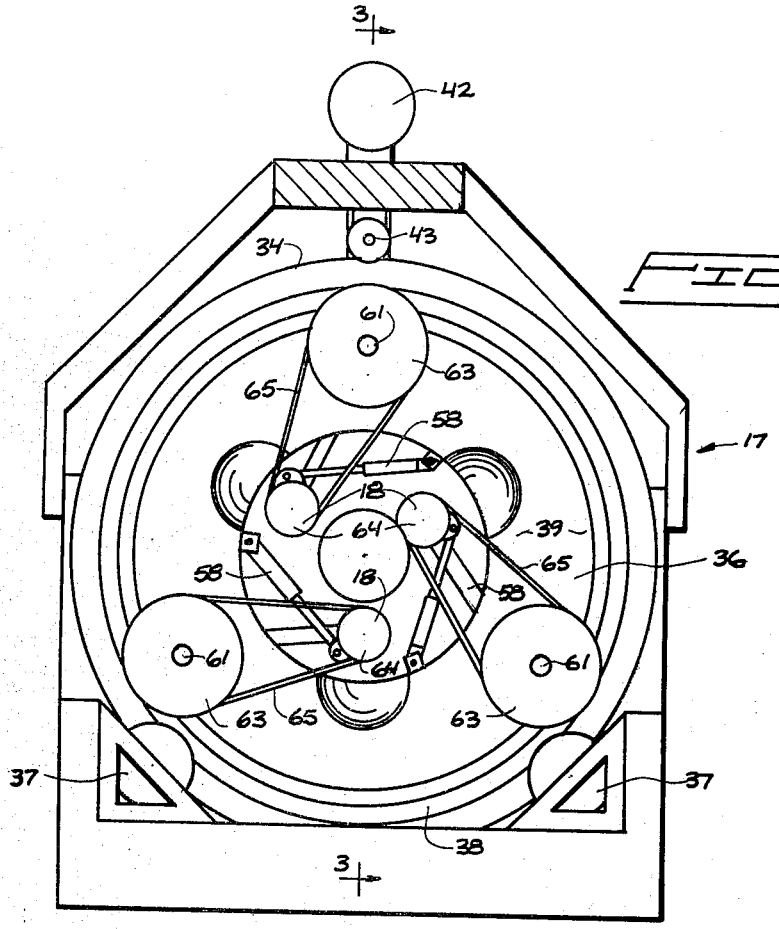
FIG. 2 is a sectional view taken along line 2—2 in FIG. 1.

FIG. 1 illustrates the conveyor means 16 extending longitudinally on opposite sides of the cutting station framework 17. The conveyor 16 is basically divided, including a feed conveyor 20 and a tail conveyor 21. Both conveyors 20 and 21 include aligned upwardly facing working flights 22. The flights 22 are simply lengths of endless chain situated within the base of V-shaped troughs 23.

The troughs 23 receive and substantially center successive logs along a defined longitudinal path for movement relative to the cutting station framework and cutting heads. The troughs prevent rolling motion of the logs as they are moved past the cutting station.

The logs are moved on the conveyors 20 and 21 by conventional electric or fluid powered drive motors 25. Removable dogs 24 mounted to the working flights of the conveyors 20 and 21, engage the ends of successive logs to move the logs along the length of the conveyor means past the cutting station and cutting heads 18.

Opposite sides of the cutting station framework 17 mount means for holding the successive logs against the conveyors and for preventing rotation of the logs about their longitudinal central axes. The hold-down means includes lever arms 29 extending longitudinally from opposite sides of the cutting station framework 17. The lever arms 29 are pivoted to the framework and are selectively pivoted by means of cylinders 30 extending between the lever arms 29 and framework 17. The lever arm at the left in FIG. 1 is shown in an operative position. The arm 29 on the right side is raised to an inoperative position to demonstrate the pivoted extremes to which the arms can move.

Free outward ends of the lever arms 29 mount pneumatic wheels 31 which frictionally engage the successive logs. The rough peripheral surfaces of successive logs are engaged by the wheel 31 on the feed conveyor side of the framework while the wheel 31 on the opposite side engages and presses downwardly against the finished log as it engages the tail conveyor 21. Both wheels 31 serve to hold the logs firmly against the conveyors 20 and 21 and therefore increase the frictional hold of the conveyor against the log. Furthermore, the wheels press downwardly against the log to resist rotation of the log about its longitudinal axis.

Figure 3:
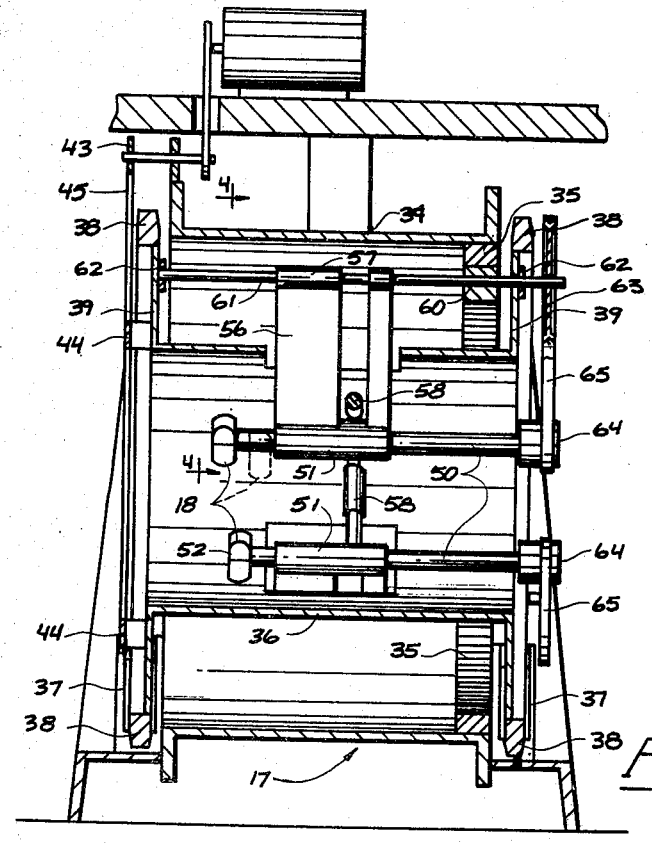
FIG. 3 is a cross-sectional view through a portion of the present log forming device taken along line 3—3 in FIG. 2.
Figure 4:
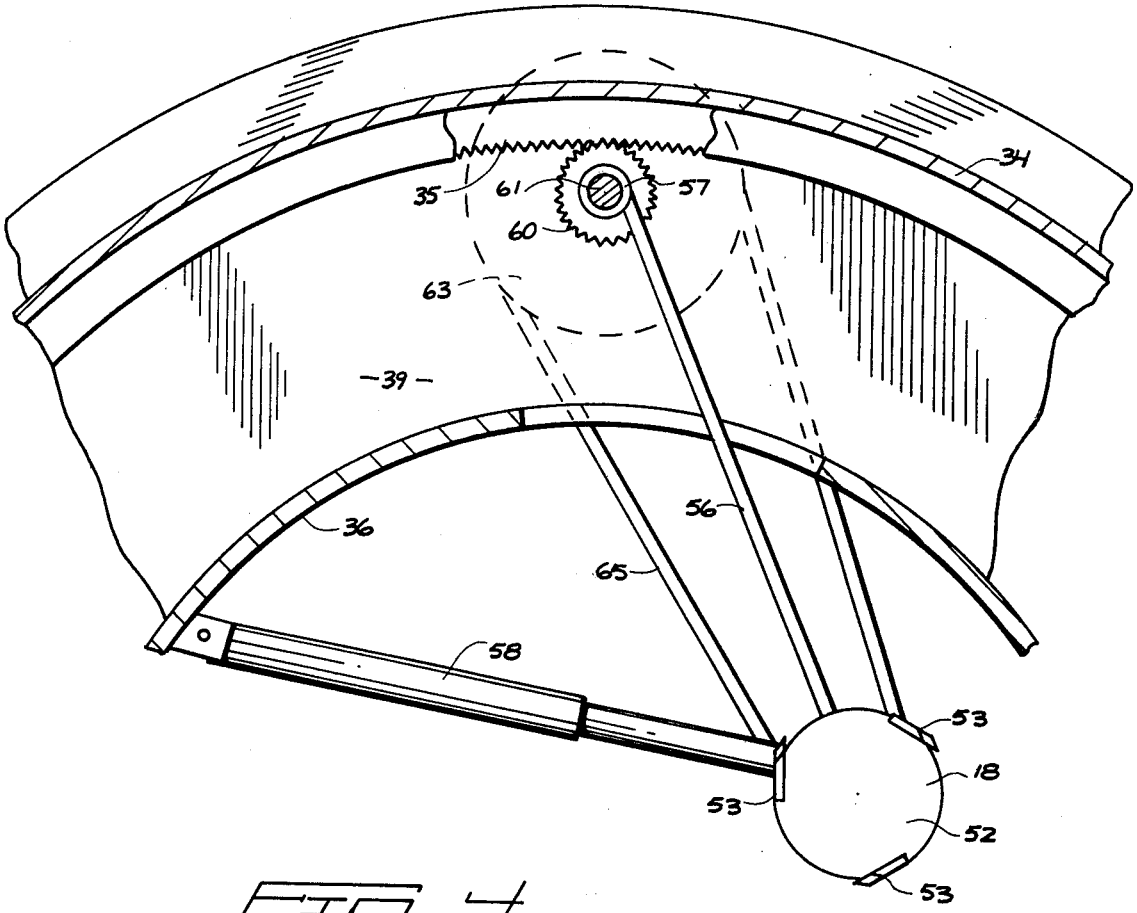
FIG. 4 is an enlarged detail view.

Important features of the present invention are situated within the enclosure of the cutting station framework 17. The framework itself basically includes a circular track 34 and supportive elements that will hold the track stationary and centered coaxially with the longitudinal center of successive logs moving through the device. Preferably, the circular track 34 includes an inwardly facing gear ring 35 (FIGS. 3 and 4).

A spool 36 is rotatably mounted by bearings 37 for rotation within the circular track 34. The bearings 37 function to hold the spool 36 in position coaxial with the log axes and allow free rotation of the spool about the coaxial axes.

The bearings 37 receive circular runners 38 formed at opposite longitudinal ends of the spool 36. The runners 38 are directly adjacent upright side plates 39 of the spool. The side plates 39 include central openings, preferably coaxial with the spool axis and large enough to allow free longitudinal passage of a log therethrough.

The spool 36 is rotated by means of a drive motor 42. The drive motor 42 is mounted to the cutting station framework 17 and may be interconnected with an appropriate form of gear reduction unit. A sprocket 43 is provided with the drive assembly that is connected by a chain 45 to a considerably larger sprocket 44 mounted on the spool 36 (FIG. 3). Sprocket 44 has an outside diameter slightly less than that of the circular runners 38. It is centered on the spool axis to rotate the spool in response to operation of motor 42.

Cutting heads 18 are shown in FIGS. 3 and 4. The cutting heads are mounted to shafts 50 that are journalled by bearings 51. The shafts 50 turn within the bearings 51 about first axes parallel to the central spool axis and parallel to the coaxial log axis. Shafts 50 have cutter heads 52 (FIG. 4) mounted at inward ends thereof. The heads 52 each mount a number of knives 53. The knives will move about the axes of the shafts 50 to cut across the grain of the logs, removing successive oval shaped chips to produce a desired surface texture, resulting in the formation of a cylindrical surface configuration along the exposed peripheral log surfaces 11.

It will be noted that there are three cutting head assemblies shown in the drawings. It is understood, however, that as few as one head may be utilized or more than three, depending upon requirements of the mill. For example, where relatively large diameter logs are to be trimmed to a subsequently smaller diameter, more cutting heads might be required.

It may also be noted that the cutting heads 52 are spaced longitudinally along the center longitudinal axis. Successive cuts at different cutting depths can thus be made as the log is moved past the cutting station (FIG. 5). A first cutting head may be radially spaced by a first distance from the central log axis to form a relatively rough initial cut about the log periphery. As the log progresses on, a second cutting head, situated somewhat closer to the central axis may complete a second, intermediate cut to further reduce the diameter of the log. Finally, the log will engage the third cutter which is placed precisely to cut the log to a desired constant diameter. A log moving past the cutting station will thus be reduced gradually by the cutting heads to the finished diameter.

The knives 53 are adjustably mounted to the heads 52 for removal and replacement or resharpening. The cutting edge configuration of the knives can be selected to determine the surface texture of the finished log. The speed of revolution of the knives, the speed of revolution of spool 36 and the longitudinal speed of the logs driven past the cutting station also affects the final finish texture. Logs can be produced with cylindrical surfaces 11 having extremely smooth textures or with a "hand hewn" texture.

The cutting heads 18 are movably mounted to spool 36 by means of pivoted adjusting brackets 56. The adjusting brackets 56 are each pivoted at 57 (FIG. 4) on the spools. The pivot axes of the brackets are parallel to one another and to the central axis of the log. Turnbuckles 58 extend between the brackets 56 and spool 36 to allow selective adjustment or radial positioning of the cutting heads at fixed selected distances from the central log axis. Selective adjustment of the turnbuckles 58 can therefore determine the finished diameter of the log and the effective diameter of any cut made previously to the finish cut. The turnbuckles 58 can also be used after each blade sharpening to reposition the cutting heads, thereby compensating for blade material lost in the sharpening process.

The cutting heads are driven to rotate in response to rotation of the spool by means interconnecting the spool and frame. As described above, the spool 36 is rotated by the spool drive motor 42 and associated sprockets and chains. The rotational movement imparted by the motor 42 is transmitted to the cutting heads through the circular track 34. As briefly indicated above, the circular track 34 is stationary on the cutting station framework 17.

The track 34 preferably includes an inwardly facing annular rack or "ring gear" 35 that is formed in a circle coaxial with the central spool and coaxial log axes.

The wheel means as used herein is defined broadly as including any appropriate rolling device that will engaage and roll against the track 34 as the spool is rotated about the stationary axis. Pneumatic tires, for example, have been used with some success. It is preferred, however, that the wheel means be supplied in the form of spur gears 60 for more positive engagement with the track 34 via the rack 35.

Gears 60 are affixed to shafts 61. The shafts 61, in turn, are rotatably journalled within the spool 36. Bearings 62 mount the shafts 61 for free rotation within the spool about parallel longitudinal axes. The spur gears 60 are designed to mesh with the ring gear on the circular hub 34. Therefore, rotation of spool 36 will cause corresponding rotation of the spur gears 60 and shafts 61.

Outward ends of the shafts 61 mount first sheaves 63. These sheaves 63 are individually connected to second sheaves 64 on the outward ends of shafts 50. Endless flexible driving members such as belts 65 interconnect the sheaves 63 and 64. Sheaves 63 and 64, and the belts 65 function as motion transfer means for rotating cutting heads 18 about their planetary first axes in response to rotation of the wheel means relative to spool 36. It should be noted here that the motion transfer means may also take other forms including for example sprockets and chains.

The pitch diameters of the spur gears 60 and the effective diameters of sheaves 63 can be selected to produce a desired rotational velocity of the cutting heads for a prescribed rotational velocity of the spool. It is preferable to have the cutting heads rotating at a substantially higher rotational velocity than that of the spool. For example, if the spool rotates at 100 rpm. the cutting heads should be rotating at several thousand rpm.

It may be noted that the shafts 61 and pivots 57 for the adjusting brackets 56 are coaxial (see FIG. 4). In fact, it is desirable to journal the brackets 56 directly on the shafts 61. By doing so, pivotal movement of the cutting heads may be accomplished without changing the effective distance between sheaves 63 and 64. Therefore, no adjustment of the belts 65 is required when the turnbuckles are adjusted to reset the radial distance from the central log axis to the cutting heads.

It is believed from the above technical description that operation of the present invention may now be easily understood.

Prior to beginning operation, the desired cross-sectional diameter of a desired finished log is determined by selectively adjusting the turnbuckles 58. The final diameter is determined by the last cutting head in the path of the forwardly moving log. However, the first two cutting heads may be adjusted through their turnbuckles 58 to take cuts of sufficient depth to progressively reduce the log diameter before the surface is engaged by the final, finishing blades of the last cutting head.

The adjustments are accomplished simply by turning the turnbuckles 58 to correspondingly pivot the cutting heads on their brackets 56 in or outwardly with respect to the central log axis.

When such adjustments have been completed, a log is placed on feed conveyor 20. It is preferred that the log previously be slabbed, to form converging flat sides complementary to the V-shaped troughs 23. The slabbed sides of the log will engage the sides of the troughs and prevent rotation of the log as it is moved toward the cutting station framework 17.

When the log is in position on the infeed conveyor, the drive motor 42 may be activated. The motor will function through the sprockets and chain to rotate the spool 36 about its central axis. As the spool rotates, so do the cutting heads. The cutting heads are rotated about the first axes of their mounting shafts 50 while the heads and shafts are being revolved about the second central rotational axis for the spool and coaxial log axis.

The sprocket and chain assembly serve to rotate the spool on the log axis. As the spool rotates, the cutting head assemblies are revolved by the spool about the log axis. The revolving spur gears 60 are in meshing engagement with the stationary ring gear 35. The gears 60 must therefore rotate on their shaft axes in planetary motion as the shafts are revolved about the log axis. Rotational motion of the gears 60 is transmitted to the cutting heads through the belts 65 and sheaves 63 and 64. Gear and sheave ratios are selected to relate the speed of revolution of the spool to the desired speed of revolution of the cutting heads.

Forward motion of the log is initiated as a dog 24 mounted to the working flight of the conveyor 20 comes into abutment with the rearward log end. The conveyor therefore pushes the log forwardly and longitudinally toward the revolving, rotating cutting heads. As the log progresses forwardly, its upper peripheral surface comes into contact with a wheel of the hold-down mechanism. The engaged wheel 31 will urge the log against the conveyor and trough and, prevent rotational movement of the log about its longitudinal axis as it progresses past the cutting station.

The forward end of the log finally leaves engagement with the working flight of the feed conveyor 20 and enters through the opening of the spool 36. The log is then engaged by the first cutter of the three. It cuts the first, rough circular swath about the log as the spool continues to rotate. This reduces the log to a first, rough cross-sectional diameter. The forwardly progressing log then comes into contact with the second cutter. The second cutter has been spaced radially inward with respect to the coaxial log and spool axes to cut a second circular swath about the log, removing material from the first diameter and reducing the log to a second, intermediate diameter. Finally, the log is moved into engagement with the third cutter which produces the final, finished diameter of the log before it exits through the opposite side of the spool and becomes engaged on the tail conveyor 21. The three progressive cuts are best shown in FIG. 5.

A finished surface of the log is engaged by a second wheel of the hold-down mechanism as it moves beyond the cutting station and onto the tail conveyors 21. This wheel serves to hold the log firmly against the tail conveyor so its working flight can move frictionally against the log to pull it through the spool and operating cutting heads. Therefore, the log is held securely by the first conveyor until enough of the log has progressed through the cutters to be received on the tail conveyor and engaged by the remaining hold-down wheel. The rearward end of the log can then pass from the feed conveyor since the tail conveyor will pull the rearward log end through the spool while maintaining its coaxial relationship with the central spool axis.

Special advantages are gained through the present device by moving the log past a relatively stationary cutting station and by moving the cutters in the described epicyclic motion.

First, this allows smaller mill dimensions since logs can move longitudinally and successively from storage on one side of the device to storage on the opposite side. The device can be placed in line along with several other devices for performing other operations, such as cut-off saws, groove-forming machines, notch cutters and the like that can operate efficiently in an "in-line" arrangement with the longitudinal conveyors.

Another advantage is that the present device does not require heavy, complicated equipment previously used to center and turn heavy logs in fixed position while a cutter is moved longitudinally to form the cylindrical surface.

Still another advantage in moving the log longitudinally relative to a cutting station is that the log can be held rigid, directly adjacent opposite longitudinal sides of the cutter mechanisms. Thus, bending does not become a factor for gauging accuracy of the cutting tools. Previously, lathe type operations have been involved where the lateral forces of the cutting tool exerted between widely spaced points of suspension at opposite ends of the log caused bending of the log and correspondingly adversely affected the accuracy of cut.

Moving the successive cutters in the described planetary motion has distinct advantages especially in mechanical simplification of the device. A single drive motor 42 can be used both to rotate the cutting heads about their own shaft axes and to revolve the cutting heads and shafts about the central log axis. The relatively high rotational speeds of cutting knives required to produce a smooth textured surface along the length of the log can be easily accomplished through the planetary arrangement.

Log feed rate can be selectively adjusted relative to the rotational speed of the cutter heads and spool in order to achieve special textured quality of the resulting cylindrical surfaces. For example, if a roughed texture is desired, the feed rate of the conveyors may be stepped up while maintaining a normal or slower rotational speed for the spool and cutter heads. If a smooth surface is desired, the conveyor feed may be reduced while cutter head speed may remain the same or be increased.

It is pointed out that the above description and drawings are given by way of example to set forth a preferred form of the present invention. The following claims, however, are intended to more particularly point out and distinctly define the invention.

What I claim is:

1. A log shaping apparatus for natural logs having a center longitudinal axis, comprising:

a rigid supporting framework;

a cutting head having peripheral knife edges centered about a first axis, adapted to form a cylindrical surface configuration about a log engaged thereby;

spool means rotatably mounted about a stationary longitudinal second axis on said framework;

mounting means supporting said cutting head on said spool means for rotation of said cutting head relative to the spool means about said first axis;

adjustment means operably connected between the spool means and said mounting means for placing said first axis at a fixed selected distance from said second axis to cut the log at a desired constant diameter;

means on said framework operably connected to said spool means for rotating said spool means about said second axis;

means on said spool means operably connected to said cutting head for rotating said cutting head relative to said spool means about said first axis in response to rotation of said spool means about said second axis;

and guide means extending longitudinally on said framework on opposite sides of said spool means for moving individual logs along a longitudinal path past the rotating cutting head with the center axis of the log maintained coaxial to said second axis.

2. The log shaping apparatus as defined by claim 1 wherein said spool means has a central opening coaxial with the second axis for receiving a log; and bearing means mounting the spool to the framework for rotation about the second axis.

3. The log shaping apparatus as defined by claim 2 wherein the means for rotating the cutting head is comprised of:

a stationary circular track on the framework concentric with and circumscribing the central opening of the spool means; and wheel means rotatably mounted to the spool means and frictionally engaging the circular track so that rotation of the spool means will cause corresponding rotation of the wheel relative to the spool means.

4. The log shaping apparatus as defined by claim 3 wherein:

the circular track includes a ring gear, and the wheel means is a spur gear meshed with the ring gear.

5. The log shaping apparatus as defined by claim 3 wherein the wheel is rotatably mounted to the spool means about an axis parallel to said first axis, the motion transfer means being comprised of:

a first sheave operably mounted to the wheel for coaxial rotation therewith;

a second sheave operably mounted to the cutting head for coaxial rotation therewith; and an endless flexible driving member interconnecting the first and second sheaves.

6. The log shaping apparatus as defined by claim 1 wherein at least two cutting heads are provided, the peripheral knife edges of a first cutting head being spaced by a first axial distance from the second axis and the peripheral knives of a second cutting head being spaced a different distance from the second axis, and wherein the cutting heads are spaced longitudinally relative to one another along the length of the second axis.

7. A log shaping apparatus for natural logs having a center longitudinal axis, comprising:

a rigid supporting framework;

a cutting head having peripheral knives with outer knife edges adapted to form a cylindrical surface configuration about a log engaged thereby;

planetary means on said framework for rotating the cutting head about a planetary first axis at the center of said knives and for simultaneously revolving the first axis in a circular path about a stationary second axis;

said planetary means comprising:

a transverse annular spool, said spool having a center opening adapted to receive a log as the log moves longitudinally relative to the spool with the log axis and said second axis being coaxial;

mounting means supporting the cutting head to said spool for rotation of the cutting head relative to the spool about said first axis;

adjustment means operably connected between the spool and said mounting means for placing said first axis at a fixed selected distance from said second axis to cut the log at a desired constant diameter;

bearing means mounting the spool to the framework for rotation of the spool about the second axis;

spool drive means on said framework and operably connected to said spool for rotating the spool about the second axis; and means on said spool operably connected between the framework and said cutting head for rotating the cutting head relative to the spool about the first planetary axis in response to rotation of the spool about the second axis.

8. The log shaping apparatus as defined by claim 7 wherein the means for rotating the cutting head about the first planetary axis is comprised of:

a stationary circular track on the framework concentric with and circumscribing the central opening of the spool;

a wheel rotatably mounted to the spool and frictionally engaging the circular track so that rotation of the spool will cause corresponding rotation of the wheel; and motion transfer means interconnecting the wheel and cutting head for rotating the cutting head about the first planetary axis in response to rotation of the wheel.

9. The log shaping apparatus as defined by claim 8 wherein:

the circular track includes a ring gear, and the wheel is formed by a spur gear meshed with the ring gear.

10. The log shaping apparatus as defined by claim 8 wherein the motion transfer means is comprised of:

a first sheave mounted to the wheel;

a second sheave mounted to the cutting head; and a flexible belt interconnecting the first and second sheaves.

11. The log shaping apparatus as defined by claim 7 wherein at least two cutting heads are provided, the peripheral knives of a first cutting head being spaced by a first axial distance from the second stationary axis and a second cutting head being spaced a different distance from the second stationary axis, and wherein the cutting heads are spaced longitudinally from one another along the length of the second axis.

* * * * *